US010766255B2

(12) United States Patent
Iwahashi et al.

(10) Patent No.: US 10,766,255 B2
(45) Date of Patent: Sep. 8, 2020

(54) ELEMENT SUBSTRATE

(71) Applicant: CANON KABUSHIKI KAISHA, Tokyo (JP)

(72) Inventors: Shinya Iwahashi, Oita (JP); Mineo Shimotsusa, Machida (JP); Sadayoshi Sakuma, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/369,263

(22) Filed: Mar. 29, 2019

(65) Prior Publication Data

US 2019/0308415 A1 Oct. 10, 2019

(30) Foreign Application Priority Data

Apr. 4, 2018 (JP) ..... 2018-072071

(51) Int. Cl.
*B41J 2/14* (2006.01)

(52) U.S. Cl.
CPC ..... *B41J 2/14129* (2013.01)

(58) Field of Classification Search
CPC ..... B41J 2/14112; B41J 2/14129
See application file for complete search history.

(56) References Cited

U.S. PATENT DOCUMENTS 4,965,594 A * 10/1990 Komuro ..... 347/62
2016/0075136 A1* 3/2016 Abbott, Jr. et al. ..... B41J 2/14112

FOREIGN PATENT DOCUMENTS

JP 3554148 B2 8/2004

* cited by examiner

*Primary Examiner* — Juanita D Jackson
(74) *Attorney, Agent, or Firm* — Venable LLP

(57) ABSTRACT

Provided is an element substrate with suppressed variations in resistance though having a high resistance. In an element substrate equipped with a heat generating resistor that generates thermal energy for ejecting a liquid, the heat generating resistor is a stacked structure having stacked a plurality of resistor layers including a first resistor layer and a second resistor layer containing a metal silicon nitride and the first resistor layer and the second resistor layer are different from each other in at least one of a silicon content in the metal silicon oxide and a metal element contained in the metal silicon nitride.

19 Claims, 9 Drawing Sheets

ELEMENT SUBSTRATE

BACKGROUND OF THE INVENTION

Field of the Invention

The present invention relates to an element substrate equipped with a heat generating resistor that generates thermal energy for ejecting a liquid.

Description of the Related Art

Some liquid ejection heads used in a liquid ejection apparatus such as ink jet printer are equipped with a heat generating resistor that generates thermal energy as an energy generating element that generates energy for ejecting a liquid. Since repeated driving of the heat generating resistor causes variations in its resistance value, a reduction in drive-induced variations in resistance value is required from the standpoint of prolonging its life.

To satisfy the above-described requirement, Japanese Patent No. 3554148 discloses the specific resistance value of a heat generating resistor and the composition of materials used therefor capable of suppressing variations in resistance value thereof.

SUMMARY OF THE INVENTION

An aspect of the present invention is an element substrate equipped with a heat generating resistor that generates thermal energy for ejecting a liquid. In the element substrate, the heat generating resistor is a stacked structure having stacked a plurality of resistor layers including a first resistor layer and a second resistor layer each containing a metal silicon nitride and the first resistor layer and the second resistor layer are different in at least one of a silicon content in the metal silicon nitride and a metal element contained in the metal silicon nitride Further features of the present invention will become apparent from the following description of exemplary embodiments with reference to the attached drawings.

DESCRIPTION OF THE EMBODIMENTS

Figure 1:
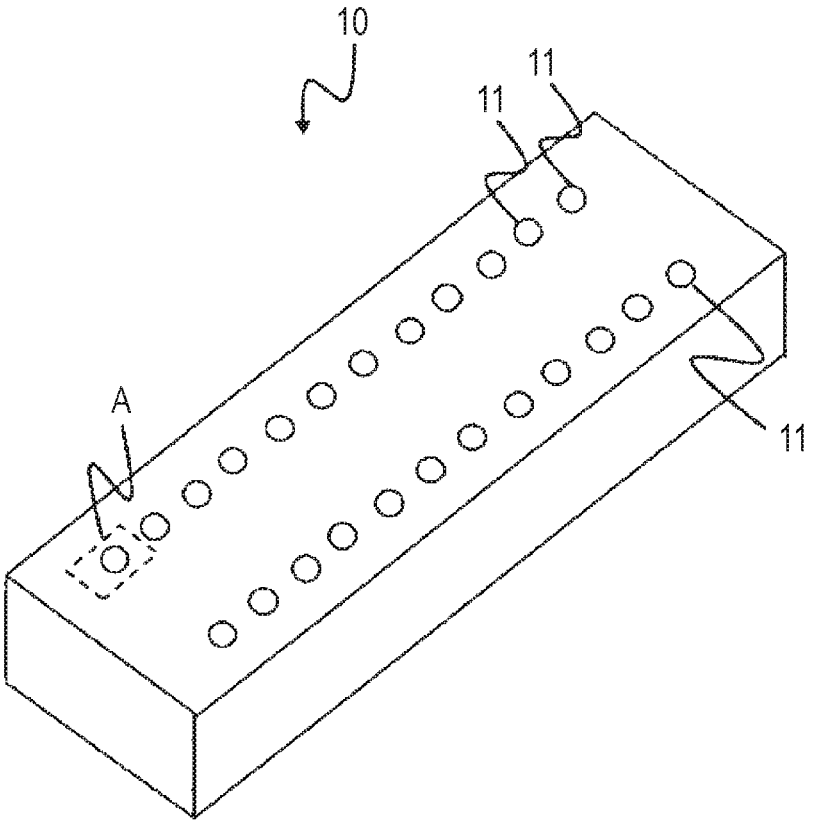
FIG. 1 is a perspective view schematically showing an element substrate according to one embodiment of the invention.

For increasing the speed of a liquid ejection head, a heat generating resistor is required to have an increased resistance, but the higher the resistance of the heat resisting resistor, the larger variations in resistance value become. There is therefore a demand for suppressing variations in the resistance value of a heat generating resistor in particular when the heat generating resistor has a high resistance. A heat generating resistor is specified to have a specific resistance value of 4000 μΩ·cm or less according to the technology described in Japanese Patent No. 3554148 so that an increase in specific resistance in order to have a heat generating resistor having a high resistance makes it difficult to suppress variations in resistance value.

With a view to overcoming the above-described problem, an object of the invention is to provide an element substrate capable of suppressing variations in resistance value even if it has a high resistance.

According to the invention, a heat generating resistor is a stacked structure having stacked a plurality of resistor layers made of respectively different metal silicon nitrides so that resistance value variation characteristics can be made different among these resistor layers. Variations in the resistance of the whole heat generating resistor can therefore be suppressed by making use of the resistance value variation characteristics of each resistor layer even without providing an upper limit in the specific resistance value of the heat generating resistor. This makes it possible to suppress variations in resistance value even if it has a high resistance.

Embodiments and Examples of the invention will hereinafter be described referring to drawings. In each drawing, members having the same function will be identified by the same reference numerals and a description on them may be omitted.

EMBODIMENT

<Element Substrate>

Figure 2A:
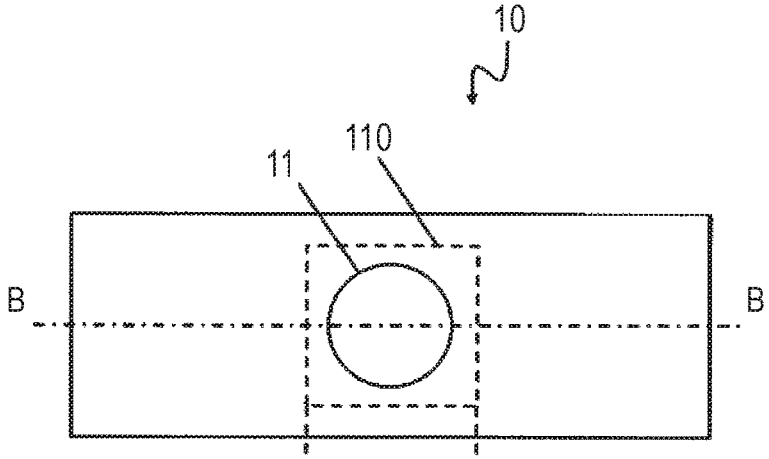
FIGS. 2A and 2B are a plan view and a cross-sectional view schematically showing an element substrate according to one embodiment of the invention.
Figure 2B:
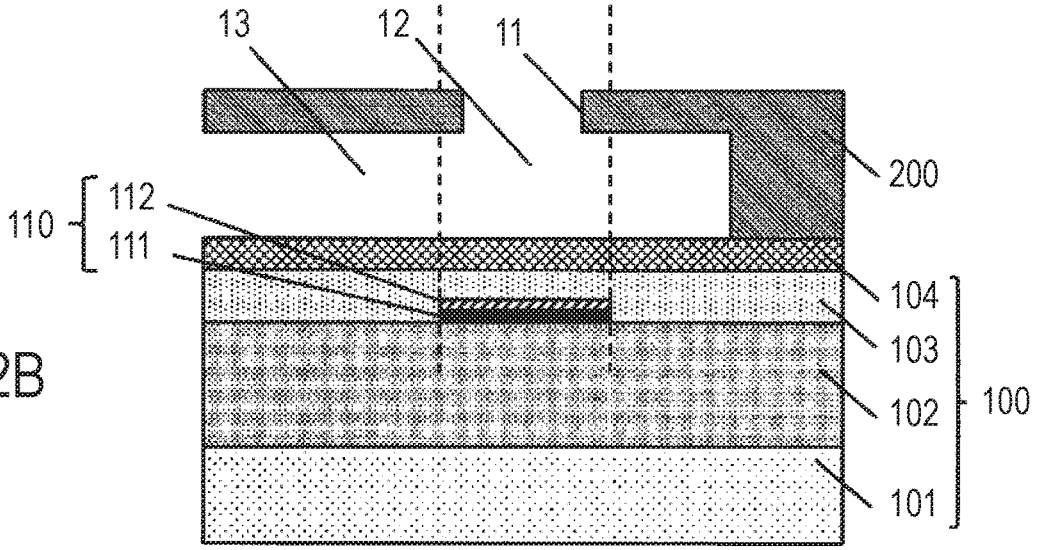

FIG. 1 and FIGS. 2A and 2B show an element substrate according to one embodiment of the invention. More specifically, FIG. 1 is a perspective view schematically showing the element substrate, FIG. 2A is an enlarged plan view of a region A of FIG. 1 and FIG. 2B is a cross-sectional view taken along a line B-B of FIG. 2A.

As shown in FIG. 1, an element substrate 10 is equipped with ejection orifices 11 for ejecting a liquid. In the example shown in this drawing, two rows of a plurality of ejection orifices 11 are arranged, but the number or arrangement of the ejection orifices 11 is not limited to this example.

As shown in FIGS. 2A and 2B, the element substrate 10 has a substrate 100 equipped with a heat generating resistor 110 that generates thermal energy for ejecting a liquid and an ejection orifice forming member 200 provided on the substrate 100.

The substrate 100 has a semiconductor substrate 101. The semiconductor substrate 101 is, for example, a silicon substrate made of single crystal silicon. The semiconductor substrate 101 has thereon a heat storage layer 102 that stores therein thermal energy generated by the heat generating resistor 110. The heat storage layer 102 is made of, for example, silicon oxide and has electrical insulation property and adequate thermal conductivity. The heat storage layer 102 has a thickness of, for example, from 1.0 μm to 3.0 μm.

The heat storage layer 102 has thereon the heat generating resistor 110. The heat generating resistor 110 is made of a resistor material such as a metal silicon nitride which is a ternary compound containing a metal element, Si (silicon) and N (nitrogen). Examples of the metal silicon nitride include WSiN (tungsten silicon nitride) and TaSiN (tantalum silicon nitride). In the present embodiment, the heat generating resistor 110 is made of a metal silicon nitride. More specifically, the heat generating resistor 110 is a stacked structure having stacked a plurality of resistor layers made of respectively different metal silicon nitrides. Each of the resistor layers of the heat generating resistor 110 has a specific resistance value of, for example, from 3000 μΩ·cm to 6000 μΩ·cm and each resistor layer has a film thickness of, for example, from 10 nm to 25 nm. To the heat generating resistor 110, a wiring (not shown) for supplying the heat generating resistor 110 with electric power is connected. The wiring is made of, for example, Al (aluminum) or Cu (copper). The heat generating resistor 110 may be directly connected to the wiring or may be connected to the wiring via a plug made of W (tungsten) or the like.

The heat storage layer 102 has thereon a protecting layer 103 for protecting the heat generating resistor 110 and the wiring from static electricity or the like and the protecting layer covers the heat generating resistor 110 therewith. The protecting layer 103 is made of, for example, silicon nitride. The protecting layer 103 has electrical insulation property. The protecting layer 103 has a thickness of, for example, from 150 nm to 300 nm.

The protecting layer 103 has thereon an anti-cavitation layer 104 for protecting the heat generating resistor 110 from impact caused by cavitation at the time when air bubbles are generated or disappear in a pressure chamber 12 which will be described later. The anti-cavitation layer 104 is made of, for example, Ta (tantalum) or Ir (iridium). The anti-cavitation layer 104 has a thickness of, for example, from 150 nm to 300 nm.

The anti-cavitation layer 104 has thereon the ejection orifice forming member 200 having therein an ejection orifice 11. By the substrate 100 and the ejection orifice forming member 200, the pressure chamber 12 having therein a liquid to be ejected from the ejection orifice 11 and a flow path 13 communicated with the pressure chamber 12 and guiding the liquid to the pressure chamber 12 are defined. The pressure chamber 12 is provided above the heat generating resistor 110 and the ejection orifice 11 is provided at a position facing the heat generating resistor 110 with the pressure chamber 12 therebetween.

In the element substrate 10 thus described above, supply of electric power to the heat generating resistor 110 through the wiring generates thermal energy at the heat generating resistor 110 and air bubbles are produced in the pressure chamber 12 by the resulting thermal energy. Due to the air bubbles, the pressure in the pressure chamber 12 increases and the liquid in the pressure chamber 12 is ejected from the ejection orifice 11.

<Heat Generating Resistor>

In the heat generating resistor 110 made of a metal silicon nitride or the like, repeated driving of the heat generating resistor 110 causes oxidation or crystallization, resulting in variations in the resistance value of the heat generating resistor 110. The oxidation of the heat generating resistor 110 contributes to an increase in resistance value, while crystallization of the heat generating resistor 110 contributes to a reduction in resistance value. This means that the behavior of the variations in the resistance value of the heat generating resistor 110 changes with oxidation characteristics and crystallization characteristics of the heat generating resistor 110 and the oxidation characteristics and the crystallization characteristics of the heat generating resistor 110 change with a material of the heat generating resistor 110. The behavior of the variations in the resistance value of the heat generating resistor 110 therefore changes depending on the material of the heat generating resistor 110.

For example, a heat generating resistor 110 made of an easily crystallizable material or a hardly oxidizable material has a reduced resistance value due to the influence of crystallization and a heat generating resistor 110 made of a hardly crystallizable material or an easily oxidizable material has an increased resistance value due to the influence of oxidation.

By forming a heat generating resistor 110 which is a stacked structure having stacked a plurality of resistor layers made of respectively different materials, it is possible to change the resistance value variation characteristics of each resistor layer and thereby reduce variations in the resistance value of the whole heat generating resistor 110.

In the present embodiment, the heat generating resistor 110 has a stacked structure having stacked two resistor layers (a first heat generating resistor 111 and a second heat generating resistor 112) made of materials having respectively different crystallization characteristics. The first heat generating resistor 111 is on the lower layer side than the second heat generating resistor 112. This means that the heat storage layer 102 has thereon the first heat generating resistor 111 and the second heat generating resistor 112 stacked in order of mention.

When the first heat generating resistor 111 and the second heat generating resistor 112 are each made of a metal silicon nitride, their crystallization characteristics differ depending on a Si content (silicon content) which is a percentage of silicon. The first heat generating resistor 111 and the second heat generating resistor 112 are therefore made of metal silicon nitrides having respectively different Si contents. For example, when TaSiN, WSiN or the like is used as the metal silicon nitride, the larger the Si content, the more easily crystallization occurs because it reduces a crystallization temperature. Therefore, the larger the Si content is, the lower the resistance value becomes due to the influence of crystallization, while the smaller the Si content is, the larger the resistance value becomes due to the influence of oxidation. One of the first heat generating resistor 111 and the second heat generating resistor 112 is made of TaSiN (or WSiN) having a large Si content to reduce the resistance value and the other one is made of TaSiN (or WSiN) having a small Si content to elevate the resistance value. For example, the Si content of one of the first heat generating resistor 111 and the second heat generating resistor 112 is set at from about 35 at % to 45 at % and the Si content of the other one is set at from about 15 at % to 25 at %.

Alternatively, the first heat generating resistor 111 and the second heat generating resistor 112 may be made of materials having respectively different oxidation characteristics. The first heat generating resistor 111 and the second heat generating resistor 112 made of a metal silicon nitride each have different oxidation characteristics, depending on the work function of a metal element constituting the metal silicon nitride. More specifically, a metal element constituting the metal silicon nitride becomes more hardly oxidizable as it has a larger work function. The first heat generating resistor 111 and the second heat generating resistor 112 are therefore made of metal silicon nitrides different in constituent metal element, respectively.

For example, WSiN is more hardly oxidizable than TaSiN because the work function of W is larger than that of Ta. One of the first heat generating resistor 111 and the second heat generating resistor 112 is made of WSiN to reduce the resistance value and the other one is made of TaSiN to elevate the resistance value.

At this time, the first heat generating resistor 111 and the second heat generating resistor 112 may have the same Si content or respectively different Si contents. When the first heat generating resistor 111 and the second heat generating resistor 112 are different in Si content, it is preferred that one of the first heat generating resistor 111 and the second heat generating resistor 112 made of WSiN has a larger Si content and the other one made of TaSiN has a smaller Si content. In this case, one of the first heat generating resistor 111 and the second heat generating resistor 112 can be made of a hardly crystallizable and easily oxidizable material and the other one can be made of an easily crystallizable and hardly oxidizable material. In this case, variations in the resistance value of the heat generating resistor 110 can be suppressed more.

Of the first heat generating resistor 111 and the second heat generating resistor 112, that having a decreased resistance value (that made of an easily crystallizable material or a hardly oxidizable material) will hereinafter be called "resistance decreasing layer" and that having an increased resistance value (that made of a hardly crystallizable material or an easily oxidizable material) will hereinafter be called "resistance increasing layer". Variation characteristics of the resistance of the heat generating resistor 110 slightly strongly reflect the influence of the first heat generating resistor 111 on the lower layer side than the second heat generating resistor 112 on the upper layer side. In order to suppress a reduction in the resistance value of the heat generating resistor 110, it is therefore preferred to form the heat generating resistor 110 so as to have the first heat generating resistor 111 as a resistance increasing layer and the second heat generating resistor 112 as a resistance decreasing layer. This makes it possible to suppress application of an excessive burden to the heat generating resistor 110.

In order to suppress an increase in the resistance value of the heat generating resistor 110, on the other hand, it is preferred to form the heat generating resistor 110 so as to have the first heat generating resistor 111 as a resistance decreasing layer and the second heat generating resistor 112 as a resistance increasing layer. This makes it possible to suppress an ejection failure such as non-ejection caused by reduction in thermal energy generated in the heat generating resistor 110.

The first heat generating resistor 111 and the second heat generating resistor 112 are preferably formed continuously under reduced pressure to prevent formation of a natural oxide film on the interface between the first heat generating resistor 111 and the second heat generating resistor 112. In addition, a ratio of the specific resistance value of the second heat generating resistor 112 to that of the first heat generating resistor 111 is preferably 2 or less.

Figure 3A:
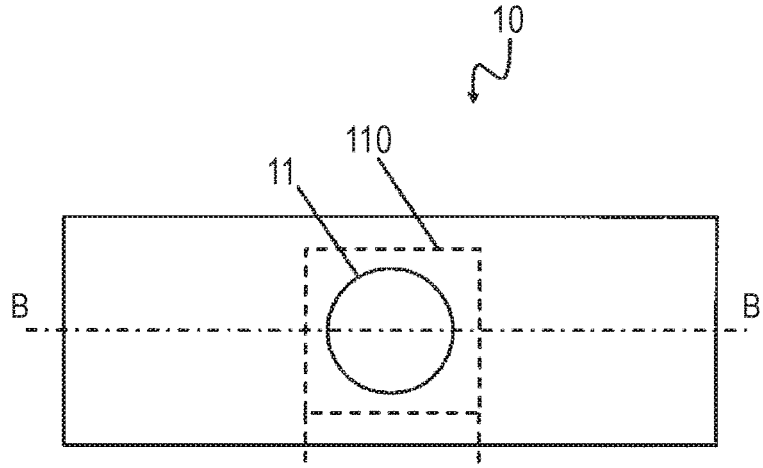
FIGS. 3A and 3B are a plan view and a cross-sectional view schematically showing an element substrate according to one embodiment of the invention, respectively.
Figure 3B:
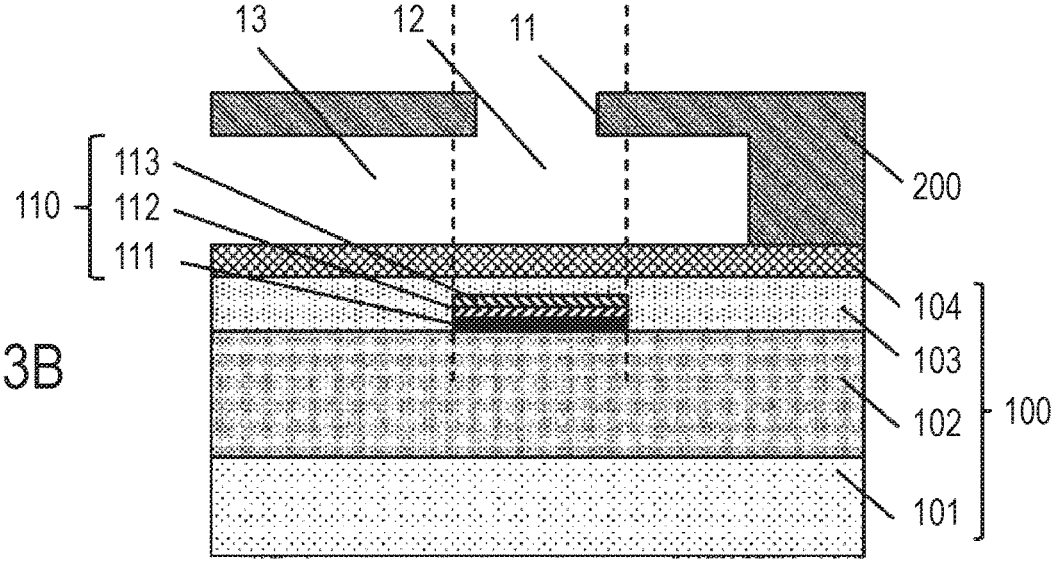

The heat generating resistor 110 shown in the example of FIGS. 2A and 2B is formed of two layers, that is, the first heat generating resistor 111 and the second heat generating resistor 112, but it may be formed of three or more layers. FIGS. 3A and 3B show an element substrate 10 having a heat generating resistor 110 formed of three layers, that is, the first heat generating resistor 111, the second heat generating resistor 112 and a third heat generating resistor 113. In this case, the first heat generating resistor 111, the second heat generating resistor 112 and the third heat generating resistor 113 are formed so that the resistance increasing layer and the resistance decreasing layer are stacked alternately.

According to the present embodiment, as described above, the heat generating resistor 110 is a stacked structure having stacked a plurality of resistor layers made of respectively different metal silicon nitrides so that variation characteristics of the resistance value of the resistor layers can be made different from one another. Without providing an upper limit for the specific resistance value of the heat generating resistor 110, variations in the resistance value of the whole heat generating resistor 110 can be suppressed by making use of the variation characteristics of the resistance value of each resistor layer, making it possible to suppress variations in resistance value even if the heat generating resistor has a high resistance.

In the present embodiment, the metal silicon nitrides constituting the resistor layers of the heat generating resistor 110, respectively, are different from one another in at least one of the silicon content and the metal element and this makes it possible to appropriately suppress variations in the resistance of the whole heat generating resistor 110.

In the present embodiment, the resistor layer include a layer made of WSiN and a layer made of TaSiN and the layer made of WSiN has a larger Si content than the layer made of TaSiN. This makes it possible to suppress variations in the resistance of the whole heat generating resistor 110.

An example of the first heat generating resistor 111 and the second heat generating resistor 112 each made of a metal silicon nitride was described above but they are not necessarily made of a metal silicon nitride. The heat generating resistor 110 is only required to be a stack of a plurality of resistor layers including a resistor (first resistor layer) showing a resistance value decreasing tendency when it is driven and a resistor (second resistor layer) showing a resistance value increasing tendency when it is driven. This makes it possible to suppress variations in the resistance value of the whole heat generating resistor 110. The term "resistance value increasing tendency" or "resistance value decreasing tendency" means a resistance value changing tendency after driving is started except variations in resistance value in a markedly short term after driving is started. Further, it is preferred that the resistance of the first resistor layer after it is driven predetermined number of times or more continuously is lower than that before it is driven and the resistance of the second resistor layer after it is driven predetermined number of times or more continuously is higher than that before it is driven. Still further, the resistance of the first resistor layer after it is driven $1\times10^8$ times or more continuously is preferably lower than that before it is driven. The resistance of the second resistor layer after it is driven $1\times10^8$ times or more continuously is preferably higher than that before it is driven. At least one of the first heat generating resistor 111 and the second heat generating resistor 112 is preferably a metal silicon nitride.

EXAMPLE 1

The element substrates shown in each Example and Comparative Example have the same constitution except for a heat generating resistor and are manufactured as described below.

First, a semiconductor substrate 101 made of single crystal silicon was provided. Predetermined members such as transistor (not shown) were formed on the semiconductor substrate 101 and then, a heat storage layer 102 having a thickness of 2.0 μm was formed on the semiconductor substrate 101. A heat generating resistor was formed on the heat storage layer 102 and the heat generating resistor and the wiring were connected to each other via a plug made of W. A protecting layer 103 having a thickness of 300 nm and made of silicon nitride was formed on the heat storage layer 102 to cover the heat generating resistor 110. An anti-cavitation layer 104 having a thickness of 300 nm and made of Ta was formed on the protecting layer 103. An ejection orifice forming member 200 was provided on the anti-cavitation layer 104 and an ejection orifice 11, a pressure chamber 12 and a flow path 13 were formed.

A durability test of the element substrate thus manufactured was performed and variations in resistance were checked. In the durability test, unless otherwise particularly specified, pulse power having a pulse width of 1.0 μs, a pulse frequency of 15 kHz and a voltage value of 20.0 V was used as electric power to be supplied to the element substrate and electric power corresponding to $1.0\times10^{10}$ pulses was supplied to the element substrate. Variations in resistance were evaluated using the maximum variation width of resistance value (=(maximum resistance value−minimum resistance value)/(initial resistance value)).

Comparative Example 1-1

A heat generating resistor made of a single layer of TaSiN (Si content: 40 at %) having a specific resistance of 4000 μΩ·cm and a film thickness of 40 nm was formed as Comparative Example 1-1.

Figure 4:
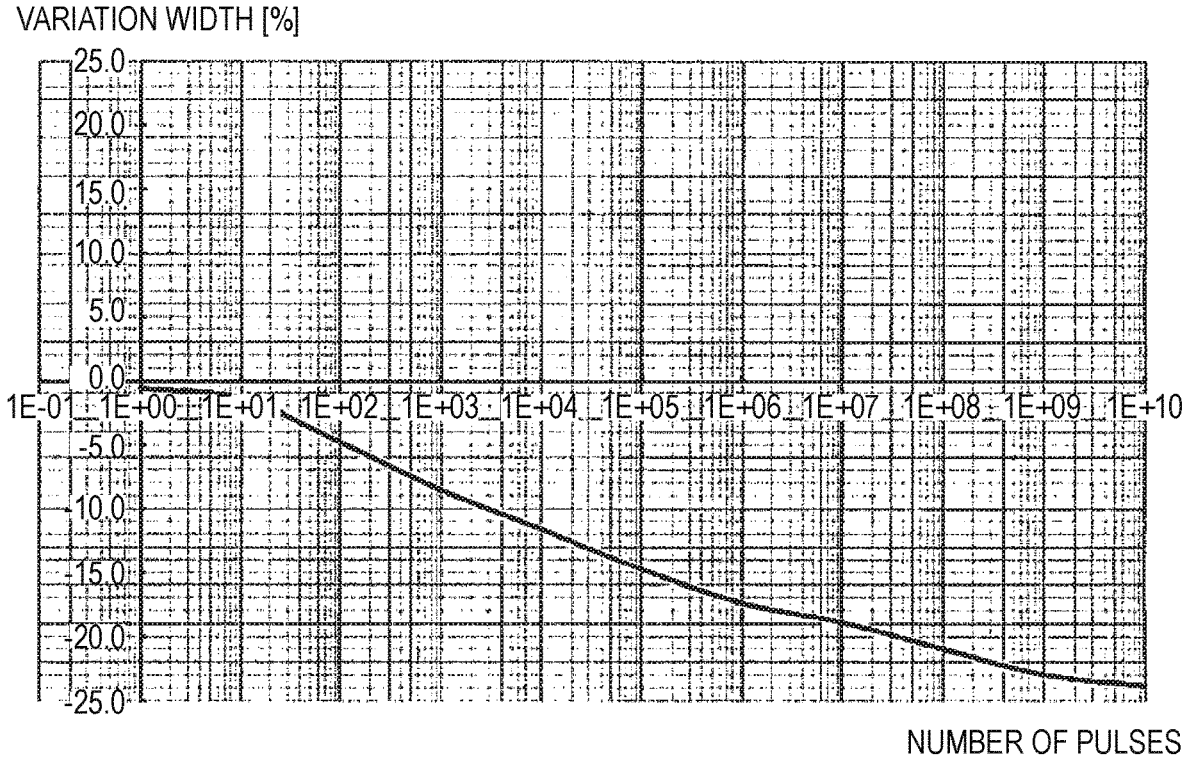
FIG. 4 is a graph showing variations in the resistance value of Comparative Example 1-1.

FIG. 4 shows variations in the resistance of Comparative Example 1-1. In FIG. 4, the number of pulses, that is, the number of application times of pulse power to the element substrate is plotted along the abscissa and a variation width of the resistance value (=(resistance value−initial resistance value)/initial resistance value) is plotted along the ordinate. The abscissa has a logarithmic scale.

As shown in FIG. 4, the resistance of Comparative Example 1-1 continues to decrease with the number of pulses and the maximum variation width of the resistance is about 24%.

Comparative Example 1-2

A heat generating resistor made of a single layer of TaSiN (Si content: 20 at %) having a specific resistance of 4000 μΩ·cm and a film thickness of 40 nm was formed as Comparative Example 1-2.

Figure 5A:
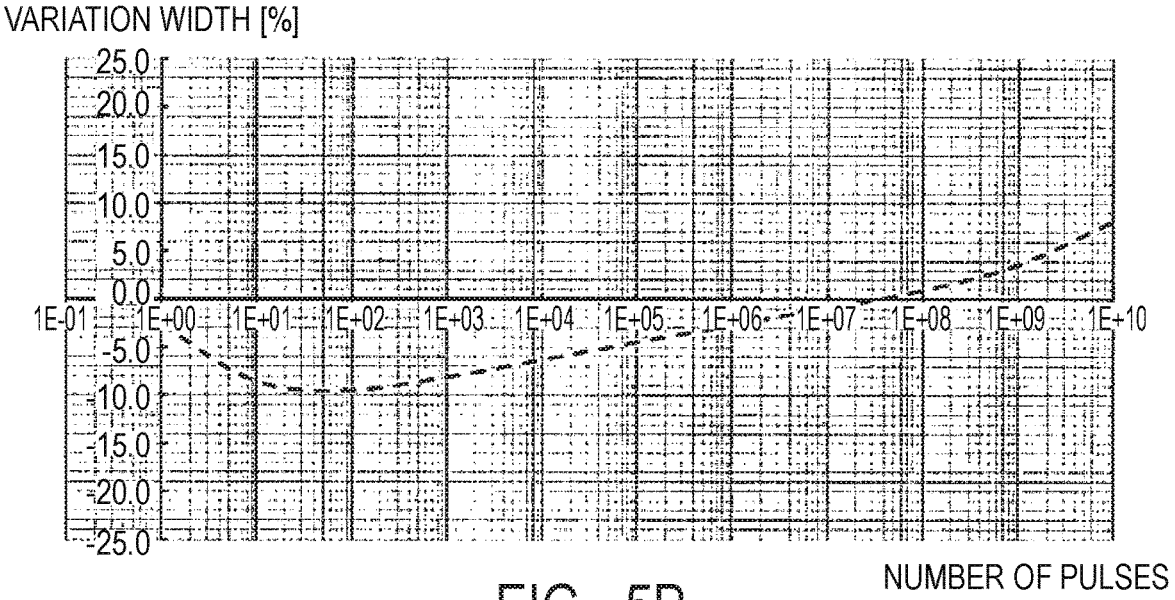
FIGS. 5A and 5B are graphs showing variations in the resistance value of Comparative Example 1-2.
Figure 5B:
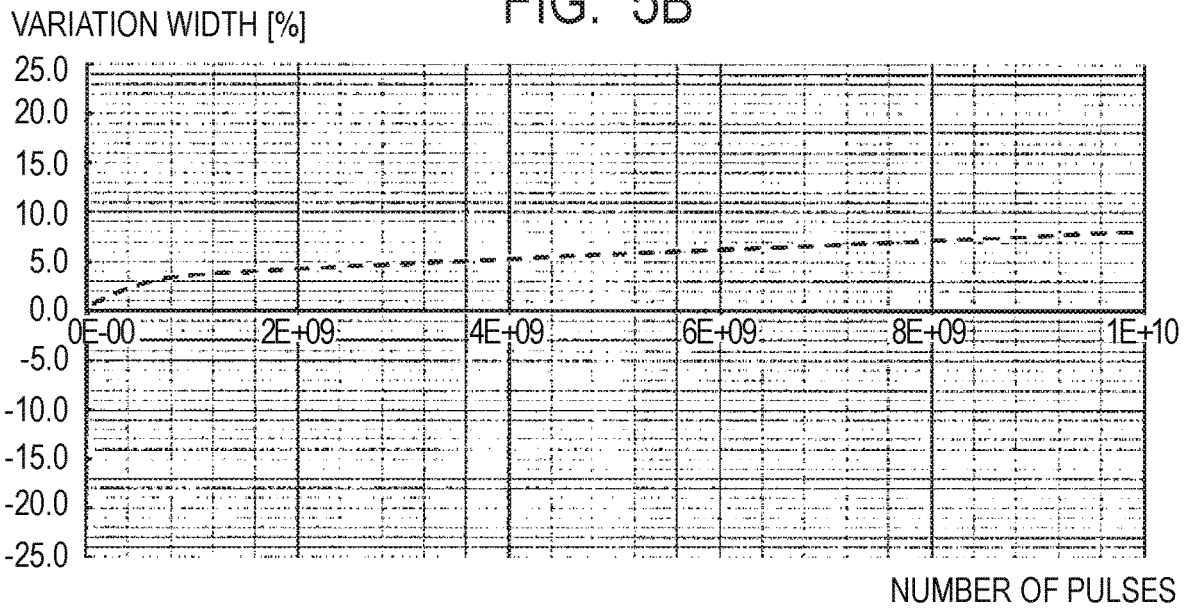

FIGS. 5A and 5B show variations in the resistance of Comparative Example 1-2. In FIGS. 5A and 5B, the number of pulses is plotted along the abscissa and a variation width of the resistance is plotted along the ordinate. In FIG. 5A, the abscissa has a logarithmic scale, while in FIG. 5B, the abscissa has a real number scale.

As shown in FIG. 5A, the resistance of Comparative Example 1-2 decreases once, but then it continues to increase. The resistance decreases during a very short period of time after the durability test is started as shown in FIG. 5B, suggesting that the resistance of Comparative Example 1-2 generally increases with the number of pulses. The maximum variation width of the resistance is about 18%.

EXAMPLE 1

Example 1 is an example of a heat generating resistor 110 formed of two layers, that is, a first heat generating resistor 111 and a second heat generating resistor 112. In this Example, the first heat generating resistor 111 and the second heat generating resistor 112 are made of metal silicon nitrides same in kind but different in Si content. More specifically, the first heat generating resistor 111 was made of TaSiN having a specific resistance of 4000 μΩ·cm, a film thickness of 20 nm and a Si content of 20 at %. The second heat generating resistor 112 was made of TaSiN having a specific resistance of 4000 μΩ·cm, a film thickness of 20 nm and a Si content of 40 at %.

Figure 6:
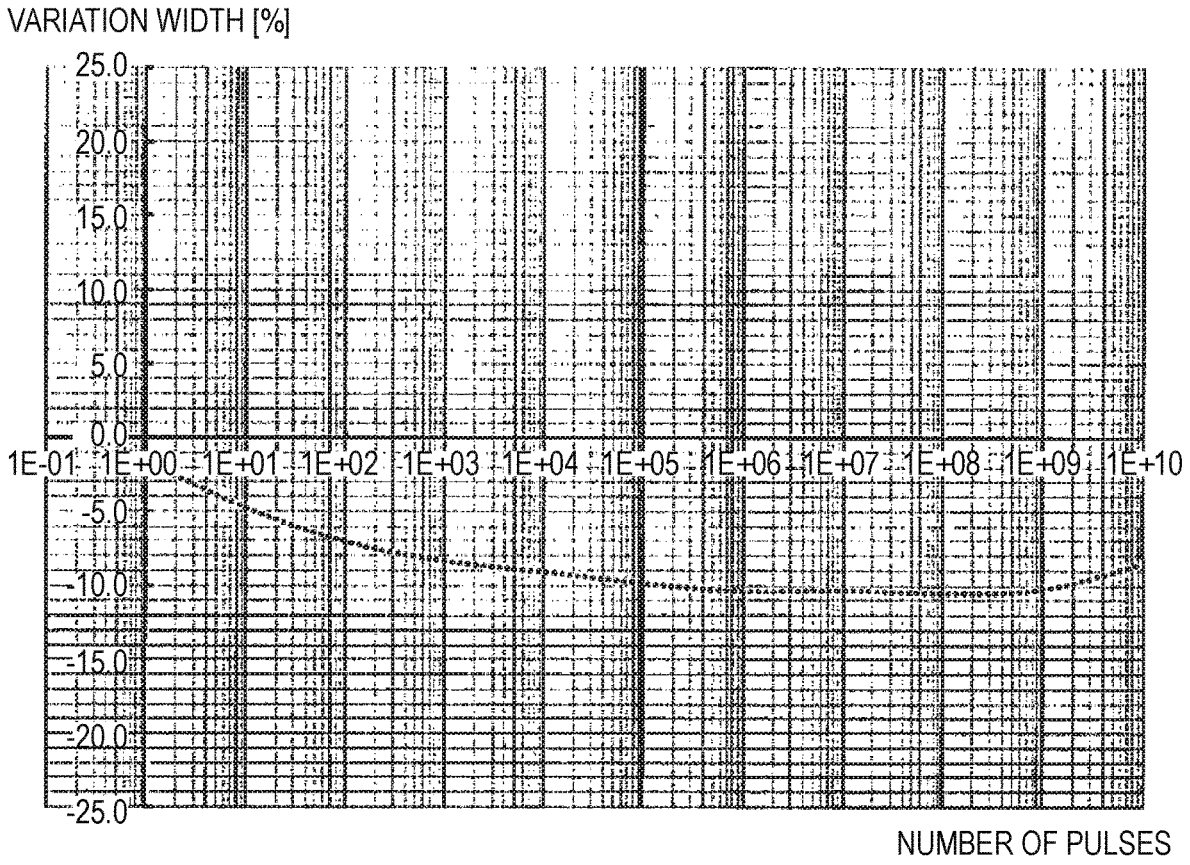
FIG. 6 is a graph showing variations in the resistance value of Example 1.

FIG. 6 shows variations in the resistance of Example 1. In FIG. 6, the number of pulses is plotted along the abscissa and a variation width of the resistance is plotted along the ordinate. The abscissa has a logarithmic scale.

In Example 1, as shown in FIG. 6, the resistance decreases, but variations in resistance is suppressed compared with those in Comparative Examples 1-1 and 1-2. More specifically, the maximum variation width of the resistance in Example 1 is about 11%, smaller than that in Comparative Examples 1-1 and 1-2.

EXAMPLE 2

Comparative Example 2-1

As Comparative Example 2-1, a heat generating resistor made of a single layer of WSiN (Si content: 40 at %) having a specific resistance of 4000 μΩ·cm and a film thickness of 40 nm was formed.

Figure 7:
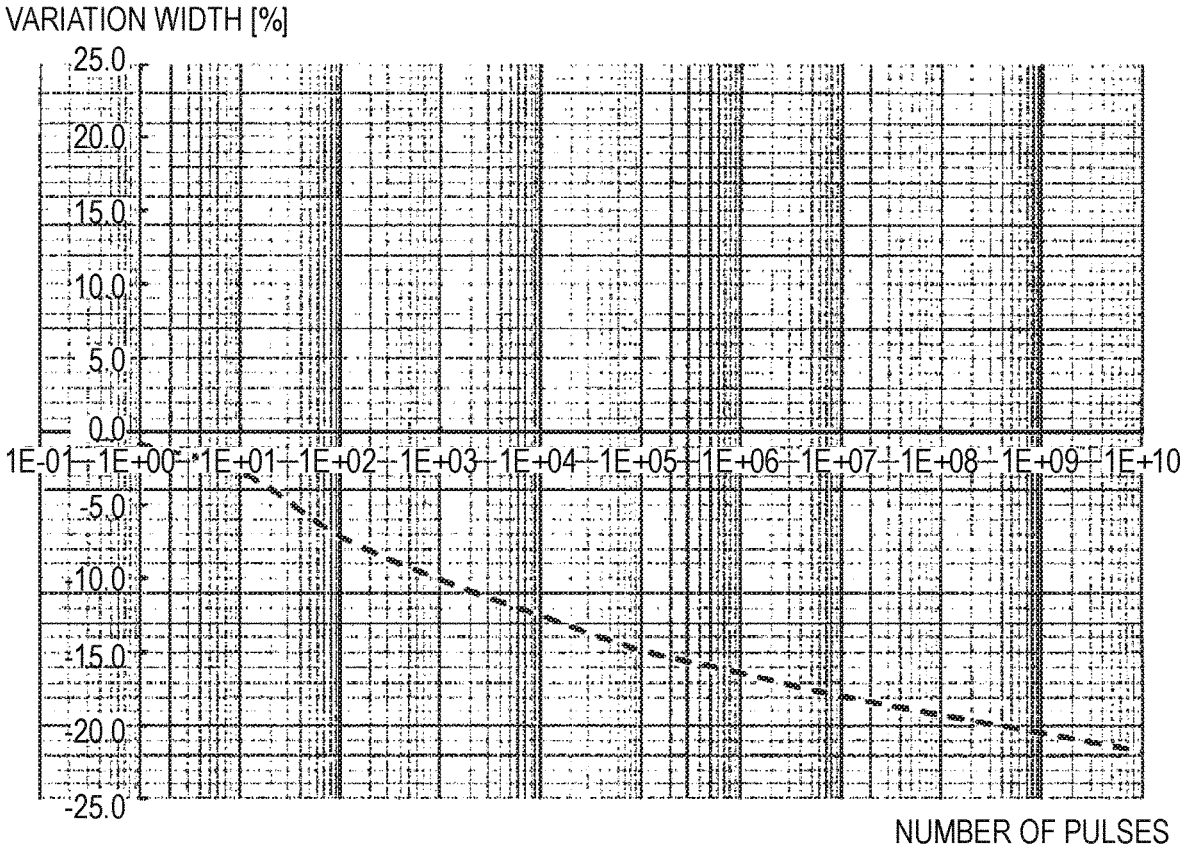
FIG. 7 is a graph showing variations in the resistance value of Comparative Example 2-1.

FIG. 7 shows variations in the resistance of Comparative Example 2-1. The number of pulses is plotted along the abscissa and a variation width of the resistance is plotted along the ordinate. The abscissa has a logarithmic scale. In Comparative Example 2-1, as shown in FIG. 7, the resistance continues to decrease with the number of pulses and the maximum variation width of the resistance is about 22%.

Comparative Example 2-2

In Comparative Example 2-2, valuations in resistance are suppressed as in Comparative Example 1-2.

EXAMPLE 2

Example 2 is an example of a heat generating resistor 110 formed of two layers, that is, a first heat generating resistor 111 and a second heat generating resistor 112. In this Example, the first heat generating resistor 111 and the second heat generating resistor 112 are made of metal silicon nitrides different in kind. More specifically, the first heat generating resistor 111 was made of TaSiN (Si content: 20 at %) having a specific resistance of 4000 μΩ·cm and a film thickness of 20 nm. The second heat generating resistor 112 was made of WSiN (Si content: 40 at %) having a specific resistance of 4000 μΩ·cm and a film thickness of 20 nm.

Figure 8:
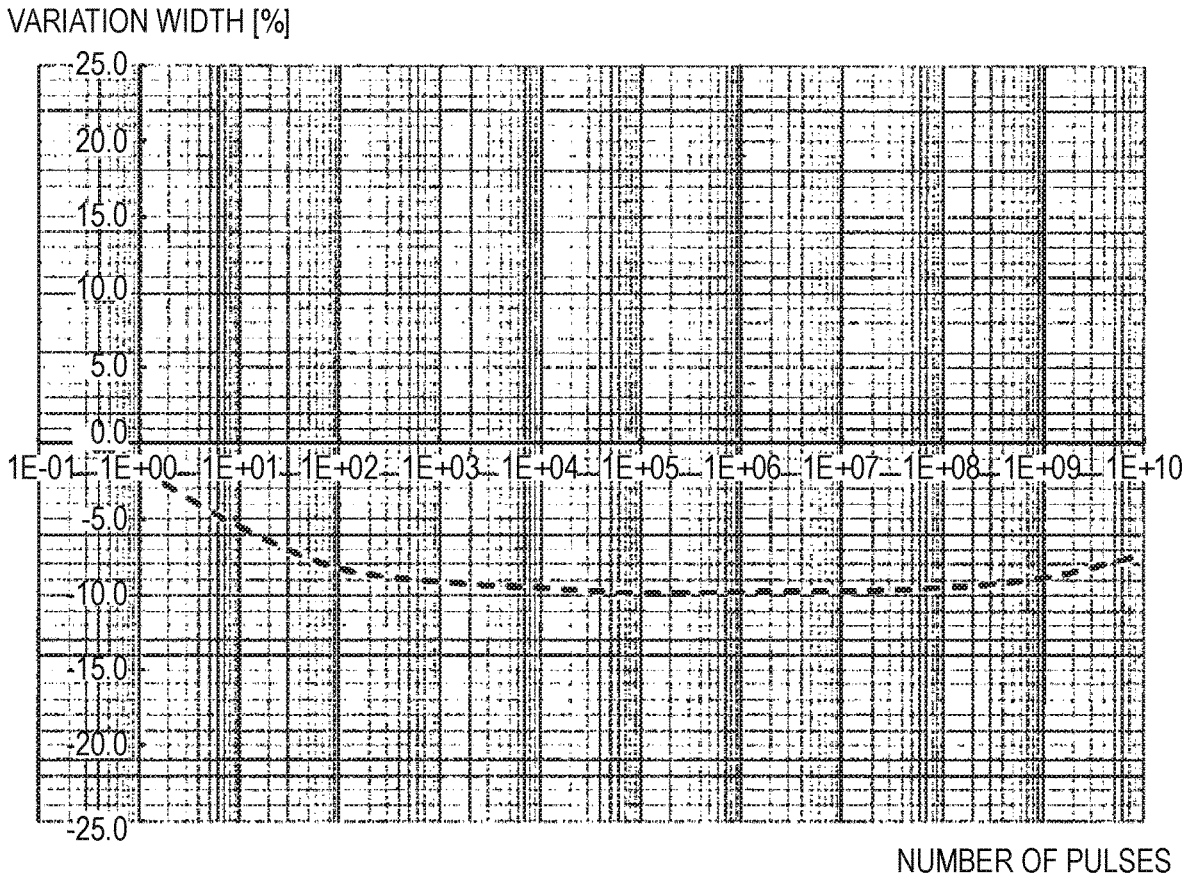
FIG. 8 is a graph showing variations in the resistance value of Example 2.

FIG. 8 shows variations in the resistance of Example 2. In FIG. 8, the number of pulses is plotted along the abscissa and a variation width of the resistance is plotted along the ordinate. The abscissa has a logarithmic scale.

In Example 2, as shown in FIG. 8, the resistance varies, but variations in resistance are suppressed compared with those in Comparative Examples 2-1 and 2-2. More specifically, the maximum variation width of the resistance in Example 2 is about 11%, smaller than that in Comparative Examples 2-1 and 2-2.

EXAMPLE 3

Example 3 is an example of a heat generating resistor 110 formed of three layers, that is, a first heat generating resistor 111, a second heat generating resistor 112 and a third heat generating resistor 113. More specifically, the first heat generating resistor 111 was made of TaSiN (Si content: 20 at %) having a specific resistance of 4000 μΩ·cm and a film thickness of 13.3 nm. The second heat generating resistor 112 was made of WSiN (Si content: 40 at %) having a specific resistance of 4000 μΩ·cm and a film thickness of 13.3 nm. The third heat generating resistor 113 was made of TaSiN (Si content: 20 at %) having a specific resistance of 4000 μΩ·cm and a film thickness of 13.3 nm. In this example, two layers, that is, the first heat generating resistor 111 and the third heat generating resistor 113 are each a resistance increasing layer and one layer, that is, the second heat generating layer 112 is a resistance decreasing layer.

Figure 9:
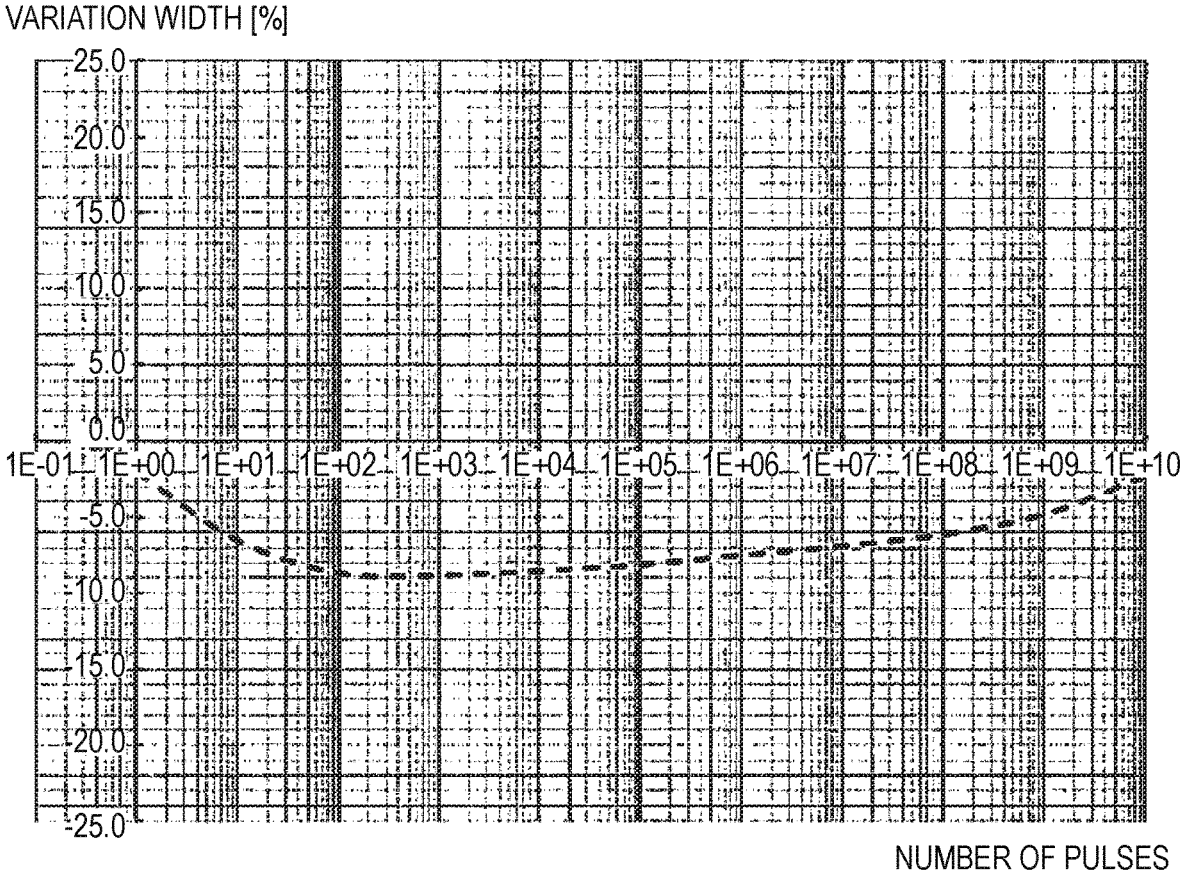
FIG. 9 is a graph showing variations in the resistance value of Example 3.

FIG. 9 shows variations in the resistance of Example 3. In FIG. 9, the number of pulses is plotted along the abscissa and a variation width of the resistance is plotted along the ordinate. The abscissa has a logarithmic scale.

In Example 3, as shown in FIG. 9, variations in resistance are more suppressed than those in Examples 1 and 2 and the maximum variation width of the resistance is about 9%.

EXAMPLE 4

Example 4 is an example of a heat generating resistor formed of a first heat generating resistor 111 and a second heat generating resistor 112 having respectively different specific resistances.

EXAMPLE 4-1

In Example 4-1, the first heat generating resistor 111 was made of TaSiN (Si content: 21 at %) having a specific resistance of 3600 μΩ·cm and a film thickness of 20 nm. The second heat generating resistor 112 was made of WSiN (Si content: 39 at %) having a specific resistance of 4400 μΩ·cm and a film thickness of 20 nm. This means that a ratio of the specific resistance of the second heat generating resistor 112 to the specific resistance of the first heat generating resistor 111 is 1.2.

In the durability test, pulse power having a pulse width of 1.0 μs, a pulse frequency of 15 kHz and a voltage of 19.9 V was used as electric power to be supplied to the element substrate. The element substrate was supplied with electric power corresponding to $1.0\times10^{10}$ pulses.

The maximum variation width of the resistance in Example 4-1 is about 10%, which is similar to that of Example 2.

EXAMPLE 4-2

In Example 4-2, the first heat generating resistor 111 was made of TaSiN (Si content: 25 at %) having a specific resistance of 2400 μΩ·cm and a film thickness of 20 nm. The second heat generating resistor 112 was formed using WSiN (Si content: 35 at %) having a specific resistance of 5600 μΩ·cm and a film thickness of 20 nm. This means that a ratio of the specific resistance of the second heat generating resistor 112 to the specific resistance of the first heat generating resistor 111 is 2.3.

In the durability test, pulse power having a pulse width of 1.0 μs, a pulse frequency of 15 kHz and a voltage of 18.3 V was used as electric power to be supplied to the element substrate and the element substrate was supplied with electric power corresponding to $1.0\times10^{10}$ pulses.

The maximum variation width of the resistance in Example 4-2 is about 15%. The present example is less effective for suppressing variations in resistance than Example 2, but is more effective for suppressing variations in resistance than Comparative Examples 2-1 and 2-2.

EXAMPLE 4-3

In Example 4-3, a first heat generating resistor 111 was made of TaSiN (Si content: 27 at %) having a specific resistance of 2000 μΩ·cm and a film thickness of 20 nm. A second heat generating resistor 112 was made of WSiN (Si content: 33 at %) having a specific resistance of 6000 μΩ·cm and a film thickness of 20 nm. This means that a ratio of the specific resistance of the second heat generating resistor 112 to the specific resistance of the first heat generating resistor 111 is 3.0.

In the durability test, pulse power having a pulse width of 1.0 μs, a pulse frequency of 15 kHz and a voltage of 17.3 V was used as electric power to be supplied to the element substrate and the element substrate was supplied with electric power corresponding to $1.0\times10^{10}$ pulses.

The maximum variation width of the resistance in Example 4-3 is about 18%, suggesting that the effect of suppressing variations in the resistance is smaller than that in another Example.

When the specific resistance of the first heat generating resistor 111 is not larger than that of the second heat generating resistor 112, a ratio of the specific resistance of the second heat generating resistor 112 to that of the first heat generating resistor 111 is preferably 1 or more to 2 or less, more preferably closer to 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-072071, filed Apr. 4, 2018, which is hereby incorporated by reference herein in its entirety.

What is claimed is:

1. An element substrate comprising a heat generating resistor that generates thermal energy for ejecting a liquid, wherein the heat generating resistor is a stacked structure having stacked a plurality of resistor layers including a first resistor layer and a second resistor layer, each containing a metal silicon nitride and the first resistor layer and the second resistor layer being different in at least one of a silicon content in the metal silicon nitride and a metal element contained in the metal silicon nitride, and wherein when the second resistor layer has a specific resistance value not more than that of the first resistor layer, a ratio of the specific resistance value of the first resistor layer to the specific resistance value of the second resistor layer is 2 or less.

2. The element substrate according to claim 1, wherein the first resistor layer and the second resistor layer are different from each other in the silicon content in the metal silicon nitride.

3. The element substrate according to claim 1, wherein the first resistor layer and the second resistor layer are different from each other in the metal element contained in the metal silicon nitride.

4. The element substrate according to claim 3, wherein the first resistor layer is made of a tungsten silicon nitride and the second resistor layer is made of a tantalum silicon nitride.

5. The element substrate according to claim 4, wherein the silicon content in the first resistor layer is larger than the silicon content in the second resistor layer.

6. An element substrate comprising a heat generating resistor that generates thermal energy for ejecting a liquid, wherein the heat generating resistor is a stacked structure having stacked a plurality of resistor layers including a first resistor layer showing a resistance value decreasing tendency by driving and a second resistor layer showing a resistance value increasing tendency by driving.

7. The element substrate according to claim 6, wherein when the second resistor layer has a specific resistance not more than a specific resistance of the first resistor layer, a ratio of the specific resistance of the first resistor layer to the specific resistance of the second resistor layer is 2 or less.

8. The element substrate according to claim 6, wherein the first resistor layer after it is driven continuously at a predetermined times or more has a smaller resistance than the first resistor layer before it is driven and the second resistance layer after it is driven continuously at the predetermined times or more has a larger resistance than the second resistor layer before it is driven.

9. The element substrate according to claim 6, wherein the first resistor layer after it is driven continuously $1\times10^8$ times or more has a lower resistance than that before it is driven.

10. The element substrate according to claim 6, wherein the second resistor layer after it is driven continuously $1\times10^8$ times or more has a higher resistance than that before it is driven.

11. The element substrate according to claim 6, wherein at least one of the first resistor layer and the second resistor layer is a metal silicon nitride.

12. An element substrate comprising a heat generating resistor that generates thermal energy for ejecting a liquid, wherein the heat generating resistor is a stacked structure having stacked a plurality of resistor layers including a first resistor layer and a second resistor layer, each containing a metal silicon nitride and the first resistor layer and the second resistor layer being different in at least one of a silicon content in the metal silicon nitride and a metal element contained in the metal silicon nitride, wherein the first resistor layer and the second resistor layer are different from each other in the silicon content in the metal silicon nitride, and wherein the silicon content in the first resistor layer is from 35 at % to 45 at % and the silicon content in the second resistor layer is from 15 at % to 25 at %.

13. The element substrate according to claim 12, wherein the first resistor layer and the second resistor layer are different from each other in the metal element contained in the metal silicon nitride.

14. The element substrate according to claim 13, wherein the first resistor layer is made of a tungsten silicon nitride and the second resistor layer is made of a tantalum silicon nitride.

15. An element substrate comprising a heat generating resistor that generates thermal energy for ejecting a liquid, wherein the heat generating resistor is a stacked structure having stacked a plurality of resistor layers including a first resistor layer and a second resistor layer, each containing a metal silicon nitride and the first resistor layer and the second resistor layer being different in at least one of a silicon content in the metal silicon nitride and a metal element contained in the metal silicon nitride, and wherein the first resistor layer shows a resistance value decreasing tendency by driving and the second resistor layer shows a resistance value increasing tendency by driving.

16. The element substrate according to claim 15, wherein the first resistor layer and the second resistor layer are different from each other in the silicon content in the metal silicon nitride.

17. The element substrate according to claim 15, wherein the first resistor layer and the second resistor layer are different from each other in the metal element contained in the metal silicon nitride.

18. The element substrate according to claim 17, wherein the first resistor layer is made of a tungsten silicon nitride and the second resistor layer is made of a tantalum silicon nitride.

19. The element substrate according to claim 18, wherein the silicon content in the first resistor layer is larger than the silicon content in the second resistor layer.

* * * * *